United States Patent [19]

Rockstead et al.

[11] 4,104,842

[45] Aug. 8, 1978

[54] BUILDING FORM AND REINFORCING MATRIX

[76] Inventors: Raymond H. Rockstead, 10041 Tesla Rd., Livermore, Calif. 94550; Wolfgang B. Fahrenbach, 3064 Rossmoor Pkwy., Walnut Creek, Calif. 94595

[21] Appl. No.: 771,999

[22] Filed: Feb. 25, 1977

[51] Int. Cl.[2] ..... E04H 12/00

[52] U.S. Cl. ..... 52/650; 52/309.12; 52/383

[58] Field of Search ..... 52/309.9, 309.11, 309.12, 52/309.17, 405, 650, 664, 577, 381, 383, 600, 612

[56] References Cited

U.S. PATENT DOCUMENTS

| | | | |
|---|---|---|---|
| 3,298,152 | 1/1967 | Lockshaw | 52/309.11 X |
| 3,305,991 | 12/1964 | Weismann | 52/600 X |
| 3,407,560 | 10/1968 | Baumann | 52/383 X |

FOREIGN PATENT DOCUMENTS

| | | | |
|---|---|---|---|
| 1,465,570 | 1/1967 | France | 52/600 |

*Primary Examiner*—Ernest R. Purser
*Assistant Examiner*—Carl D. Friedman
*Attorney, Agent, or Firm*—Warren, Chickering & Grunewald

[57] ABSTRACT

A skeleton wall structure providing a form and matrix for building walls (both exterior and interior and including floors and ceilings) for providing a reinforced concrete or similar type structure.

5 Claims, 9 Drawing Figures

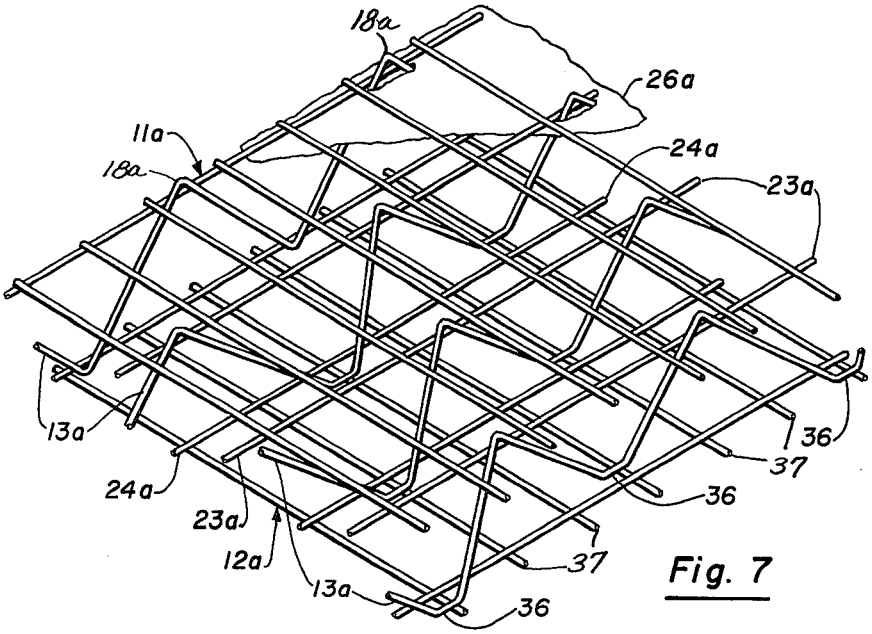
Fig. 7
Fig. 8
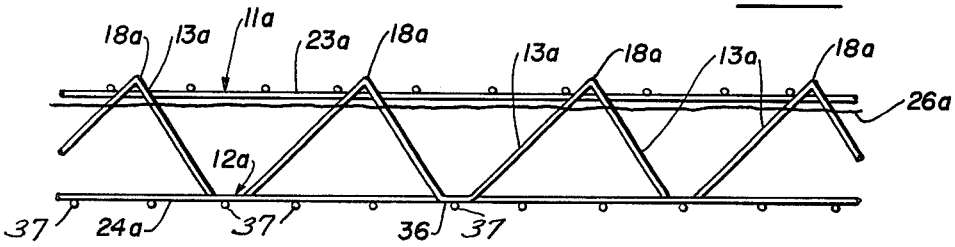
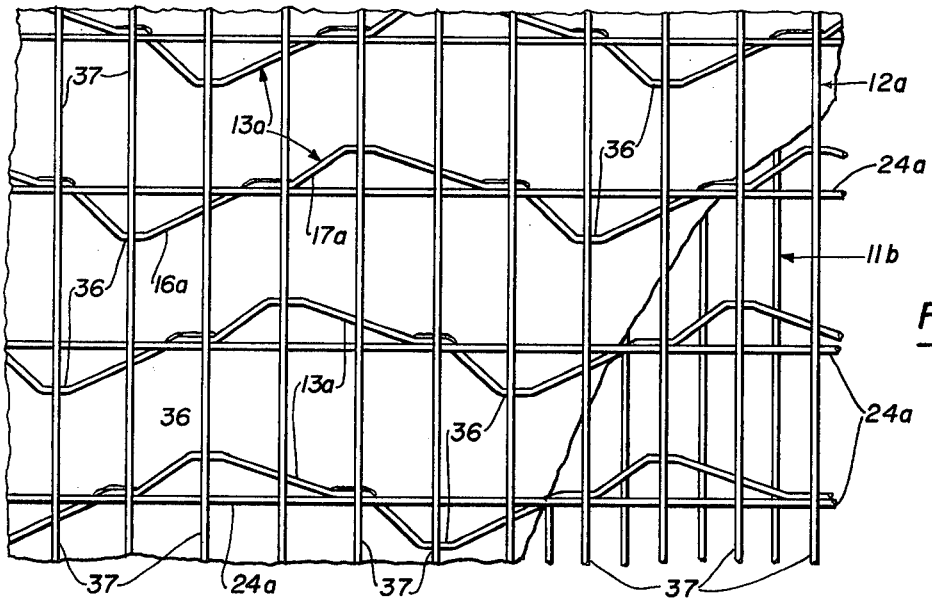
Fig. 9

BUILDING FORM AND REINFORCING MATRIX

BACKGROUND OF THE INVENTION

1. Field of the Invention

The invention relates to the erection and completion of reinforced concrete building wall structure in which a skeleton reinforcing matrix is first set in place and then concrete or similar material applied thereto, see, for example, U.S. Pat. No. 3,305,991.

2. Description of Prior Art

The structure of U.S. Pat. No. 3,305,991 comprises a modular wire framework panel designed for erection and receipt of concrete to provide a reinforced concrete wall. To facilitate the application of concrete, the structure of U.S. Pat. No. 3,305,991 includes a centrally positioned partition wall of polyurethane foam which affords core insulation and a support against which concrete can be applied from the opposite sides of the wall, the application being most expeditiously accomplished by pressure spraying of the concrete by the well known Gunite process. Plumbing parts and electrical lines may be mounted in the wall framework prior to the application of the concrete and buried therein so long as the plumbing and electrical members are formed to resist the corrosive attack of the concrete. Construction of walls having a completely open dead air space therein is not possible using known prior art structures and techniques, nor is it possible to form or fill the wall core with any of the available variable density insulated concrete or self-supporting plastic insulating materials. Prior art structures have also not been designed for use with form walls for most effectively embedding the reinforcing matrix within the wall being formed and to provide special surface effects which may be sought.

SUMMARY OF THE INVENTION

An object of the present invention is to provide a building form and reinforcing matrix of the character described which may be quickly, easily and precisely erected, followed by expeditious completion of finished concrete walls and which will afford complete freedom of selection of wall core structure, including open dead air space, inclusion of loose insulation material, or filling with a self-supporting plastic insulation mass, and in any and all such core structures, enabling the inclusion of plumbing and electrical lines without requiring any special precaution against the normally expected corrosive attack on these parts of concrete.

Another object of the present invention is to provide a building form and reinforcing matrix of the character described which is specially formed for use in conjunction with form boards and the like to provide specially desired surface effects and ornamentation and which will, at the same time, correctly index the reinforcing matrix for full and most effective embedding in the concrete.

A further object of the present invention is to provide a building form and reinforcing matrix of the character above which will afford improved wall strength without common weakening and disfiguring cracks and finish out to a recognized standard wall thickness for use with conventional hardware, windows, doors, etc.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

BRIEF DESCRIPTION OF THE DRAWINGS

FIG. 7 is a perspective view of a modified form of the panel.

FIG. 8 is a fragmentary edge elevation of the panel illustrated in FIG. 7.

FIG. 9 is a bottom view of the panel illustrated in FIG. 7.

DETAILED DESCRIPTION OF INVENTION

Figure 1:
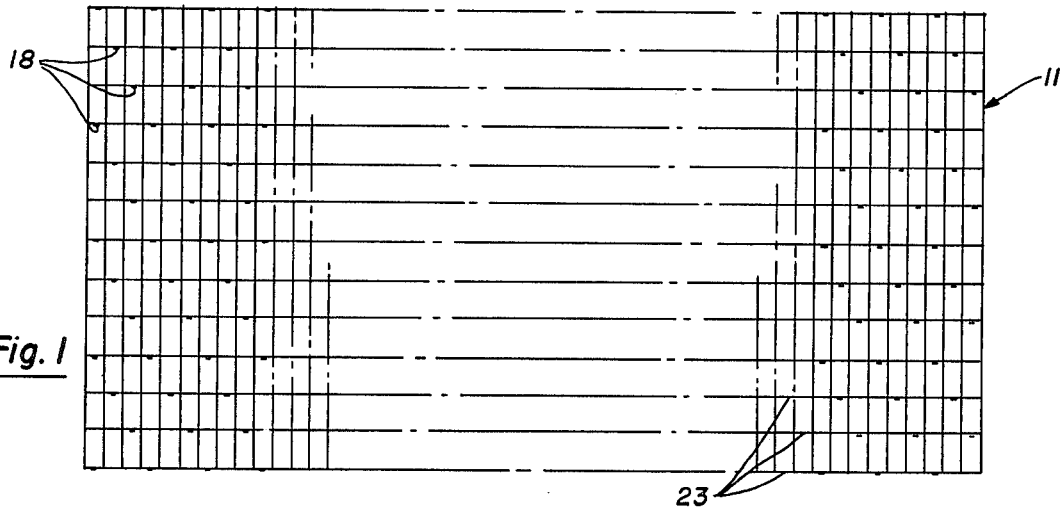
FIG. 1 is a front view of a modular building form and reinforcing matrix panel constructed in accordance with the present invention.

The building form and reinforcing matrix illustrated in the accompanying drawing comprises, briefly, a pair of mesh sections 11 and 12; a plurality of sinuous truss members 13 extending between and secured to and supporting sections 11 and 12 in spaced-apart planes, the truss members defining angularly related sides 16 and 17 between sections 11 and 12 and being joined in apexes 18 and being connected to at least one of sections 11 and 12, with apexes 18 projecting outwardly therefrom in spaced relation thereto, as best seen in FIGS. 1–4 of the drawings. In practice, apexes 18 project out about ½ inch from sections 11 and 12 so as to form an index of definition for the final wall surfaces 21 and 22, see FIGS. 5 and 6, wherein mesh sections 11 and 12 are fully and completely buried within the finished concrete wall to provide most effective reinforcing of the wall. Construction of the concrete wall is more fully hereafter discussed, but in connection with apexes 18, it may be noted that the latter all lie in a common plane spaced from and parallel to the adjacent wire mesh sections so that form boards and the like may be supported on the apexes for forming of the concrete wall or the dual purpose of providing special surface effects and proper embedding of the reinforcing mesh structure. Where the concrete is applied by a spray-on technique, the concrete is built out to the apexes 18, thus defining the limit of the finished wall and the proper and most effective inclusion of the reinforcing matrix. Sections 11 and 12 may be composed of standard commercially available rectangular wire mesh, including a plurality of substantially parallel, longitudinally extending wires 23 for section 11 and 24 for section 12, which are bonded, as by welding, to a plurality of substantially parallel, transversely extending wires 25 for section 11 and 28 for section 12. A standard 2 inches × 4 inches spacing of 12½ gauge steel wire is quite satisfactory. The truss members 13 may be composed of 12-gauge steel wire mounted on 4-inch centers in the plane of opposed longitudinally extending wires 23 and 24 of the two mesh sections. The panels are preferably constructed in a standard 4-foot width in lengths typically 6', 8', 9', 10' and 12'.

Figure 2:
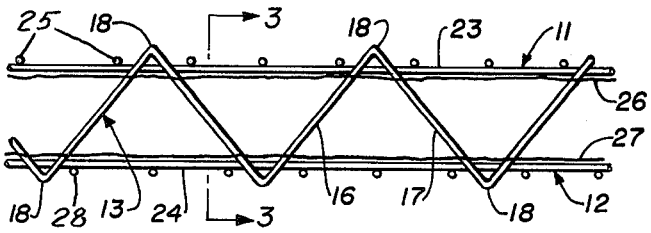
FIG. 2 is a fragmentary enlarged edge elevation of the panel.
Figure 3:
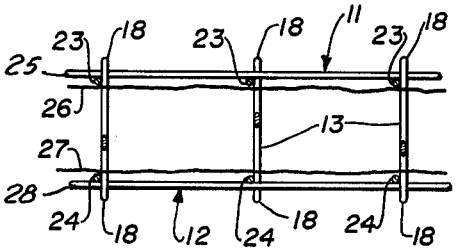
FIG. 3 is a fragmentary cross-sectional view of the panel taken substantially on the plane of line 3-3 of FIG. 2.
Figure 4:
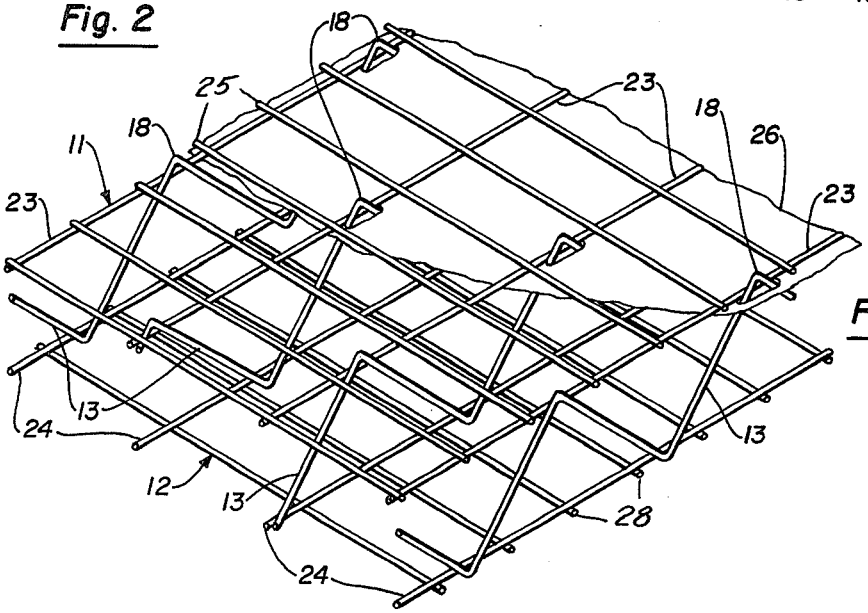
FIG. 4 is a fragmentary perspective view of the panel.

As will be best observed from FIGS. 2–4, the longitudinal mesh wires 23 and 24 will traverse each pair of angularly related sides 16 and 17 of the trusses in spaced relation to their connected apex 18; and in accordance wtih the present invention, the longitudinal mesh members 23 and 24 are bonded, as by spot welding, to sides 16 and 17 to provide a rigid two-point triangular support for the outwardly projecting apexes 18. Also, as will be observed, the joinder of transverse wires 25 and 28 to longitudinal wires 26 and 27 are at positions spaced from the joinders of the truss members to the longitudinal wires, thereby spacing apexes 18 from any of the transversely extending wires 25 and 28. Moreover, the several truss members are positioned so that the apexes 18 of transversely adjacent truss members are offset longitudinally from each other, with the apexes defining a diamond-shaped pattern, as seen in the front view, FIG. 1.

In accordance with the present invention, one or more partitions 26 and 27 are carried by truss members 13 between sections 11 and 12; and as a feature of the present invention, these partitions may comprise a simple sheet pierced by apexes 18 and mounted interiorly of the adjacent mesh section and supported on adjacent diverging sides 16 and 17 of the truss members. Common building paper may be used for this purpose, the paper sheets being positioned in place on the truss members prior to the welding of the adjacent mesh section thereto. Any desired sheet of frangible material may be used for this purpose. The purpose of the partition sheet is to facilitate the application of the concrete skins which will provide the finished wall and to define the interior core space 31 of the wall.

Figure 5:
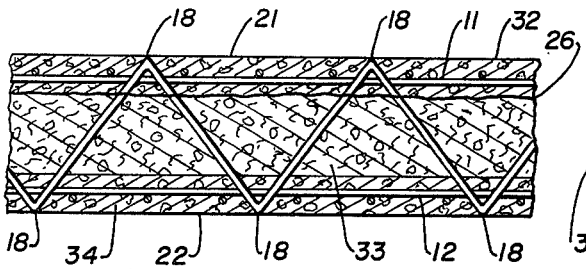
FIG. 5 is a cross-sectional view of a section of finished wall constructed in accordance with the present invention.
Figure 6:
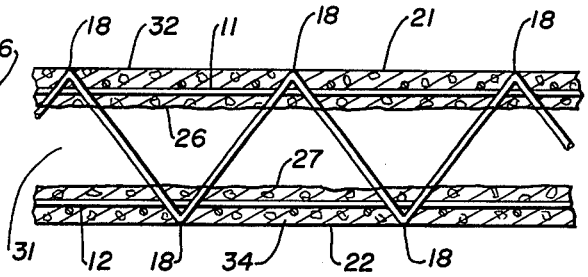
FIG. 6 is a cross-sectional view of another form of finished wall constructed in accordance with the present invention.

Normally, the matrix panels of the present invention will be erected on a foundation when they are to define a building wall and secured together over the length of the wall by wiring together, cinching with hog rings and the like. Thereafter, concrete may be applied to the matrix, either by troweling or by spray application, using one of the partitions 26–27 as a backing and the concrete wall built out to the extremity of the apexes 18, thus fully embedding one of the mesh sections 11–12 and forming, typically, about a 1-inch concrete wall 32, as seen in FIGS. 5 and 6. The structure of the present invention provides various alternative techniques for completing the wall. One preferred system is to proceed from the opposite side of wall 32 by using the interior of wall 32 as a support against which to apply, as by spraying, a self-supporting plastic insulating mass 33, which will embed therein plumbing, electrical wiring and the like, and form the core of the wall. Various types of variable density insulated concrete may be used for this purpose. One preferred material is the combination of rock wool and a plastic resin binder cement, such as manufactured by Spray Craft. Other self-supporting plastic insulating masses combining insulating fiber, shredded plastic foam waste, plastic cement and Portland cement may be used. If desired, the core space 31 may be filled with a plastic foam sprayed in place or simply packed with rock wool or the like. Where the core area 31 is filled, as above described and as illustrated in FIG. 5, the opposite concrete wall skin 34 may be applied as by troweling or spraying, using the interior core as a backing support. As in the case of wall section 32, wall 34 is built out to the extremity of apexes 18, thus fully and most effectively embedding mesh section 12 in the wall. Typically, wall 34 will be approximately 1 inch thick, leaving an interior core section 33 of approximately 2½ inches in thickness. In the foregoing described wall structure, and as illustrated in FIG. 5, only one interior partition sheet 26 need be used, since the interior core structure 33 will provide the backing for supporting the application of the concrete wall 34. If desired, the interior surface of partition sheet 26 may be sealed by a coating applied thereto, as by spraying, from the opposite side of the wall. Liquid tar or other sealer may be used for this purpose. In the wall structure depicted in FIG. 5, insulating core material is used which is inert in respect to plumbing, electrical lines and the like, which may be embedded therein. As will be understood, in the wall constructed as shown in FIG. 5, the steel mesh and truss members carry the tensile load; the concrete skins, the compressive load; and the combination resists shearing forces. The core area is not relied upon for structural strength.

The inclusion of a second interior partition sheet 27, as optionally illustrated in FIGS. 2 and 3, permits the construction of a wall, as seen in FIG. 6, with two spaced-apart concrete skins 32 and 34 with a wholly open dead air space 31 in the core area of the wall. In this construction, concrete wall 32 is laid up against interior partition sheet 26, and wall section 34 is laid up against interior partition sheet 27 by any of the well known concrete-applying techniques. As a further alternative, not illustrated, form boards may be placed on opposite sides of the matrix panel, supported on apexes 18, and the wall poured solid. Other alternatives include the placing of form boards only at one side of the panel against apexes 18 and concrete applied from the opposite side of the panel to form either a thin wall section or a full solid wall. In any of the described structures, additional conventional reinforcing steel may be added.

In the form of the invention illustrated in FIGS. 1–6, the mesh sections 11 and 12 are mounted in substantially parallel planes and the truss members 13 are mounted in spaced parallel planes substantially perpendicular to the planes of sections 11 and 12. Also, the longitudinal truss members 23 and 24 are positioned in the planes of the truss members with the angularly related sides of the truss members bonded thereto, as above described. A modified form of the invention is illustrated in FIGS. 7–9, wherein truss members **13*a* are offset transversely from their longitudinal dimension at their points of connection to mesh sections 11*a* and 12*a* to provide what may be termed as a "double shear structure," that is, a structure which resists shear in two directions. Preferably, truss members 13*a* are fashioned with pointed apexes 18*a* at one side of their sinuous form and which may be bonded to longitudinal members 23*a* of one mesh section 11*a*. In this form of the invention, however, the trusses 13*a* do not proceed from apexes 18*a* in the same plane, but the two angularly related sides 16*a* and 17*a*, which extend from apexes 18*a*, diverge laterally to opposite sides of a symmetrical, central, longitudinal plane of the truss members. Accordingly, the opposite ends 36 of the sinuous truss members are offset from the longitudinal wires 24*a* of the opposite mesh section 12*a* and secured, as by welding, to the cross wires 37 of mesh section 12*a*. In this form of the invention, the two mesh sections may be offset, as seen in FIG. 9, so as to locate the ends 36 on cross wires 37. Preferably, wire ends 36** are flattened, as seen in FIGS.

7-9, to facilitate their location on and welding to cross wires 37. In this structure, the flattened wire ends 36 form truncated broadened foot portions with respect to the diverging truss sides connected thereto, and the foot portions are positioned medially on, and bonded to, one of the transverse wires 37, thus spacing the connected truss sides from the connected transverse wire 37. A partition sheet 26*a* may be pierced by apexes 18*a* and mounted on the angularly related sides of the truss members interiorly of the mesh section 11*a* in the same manner as the first-described embodiment and as is illustrated in FIGS. 7-9. Also, the double bonding of the angularly related sides of the truss members to longitudinal wire 23*a* adjacent apexes 18*a* is preferably effected as in the first-described embodiment.

While the matrix of the present invention will be typically used in the erection of concrete walls (including floors, ceilings and roof structures), it may also be used for the holding and reinforcing of other materials, such as, for example, adobe, which may be applied as hereinabove described. In such case, the interior partition seal may be of particularly importance in maintaining the wall integrity and waterproofing upon washing away of the exterior adobe skin. The term "cementitious material," as used herein, is intended to include adobe and like materials.

What is claimed is:

1. A building form and reinforcing matrix comprising:

a pair of wire mesh sections having a plurality of substantially parallel longitudinally extending wires bonded to a plurality of substantially parallel transversely extending wires;

a plurality of sinuous wire truss members extending between and secured to and supporting said sections in spaced-apart substantially parallel planes, said truss members running generally longitudinally of said sections and being spaced apart transversely of said sections;

said truss members having angularly related sides joined in apexes with said sides mounted upon and bonded to the longitudinal wires of one of said sections at positions spaced from their connected apexes to provide an outward projection of said apexes from said longitudinal wires in a rigid triangular structure;

the joinder of said transverse wires to said longitudinal wires being at positions spaced from the joinders of said truss members to said longitudinal wires, thereby spacing said apexes from any transversely extending wires; and said truss members being positioned so that the apexes of transversely adjacent truss members are offset longitudinally from each other.

2. The structure of claim 1, and a frangible sheet pierced by said apexes and mounted between said mesh sections and generally parallel thereto and supported on adjacent diverging truss member sides.

3. The article of claim 2, and cementitious material carried by said matrix and extending from said last-named apexes to one side of said sheet;

a self-supporting plastic insulating mass carried by said truss members in engagement with and extending from the opposite side of said sheet; and cementitious material mounted on said insulating mass and extending therefrom in a direction away from said first-named cementitious material to embed therein the adjacement mesh section.

4. The article of claim 2, said truss members having pointed apexes at opposite extremities of their sinuous extensions;

a second sheet of frangible material pierced by said pointed apexes and supported on said members between said sections in spaced-apart position to said first-named sheet.

5. The structure of claim 1, adjacent converging sides of said truss members being connected at their ends remote from said apexes in truncated broadened foot portions positioned medially upon and bonded to one of said transverse wires of the other mesh section, each said foot portion spacing its connected sides from the connected transverse wire; and said truss members diverging from each other transversely of said sections to thereby position said foot portions alternately in transversely offset relation to and on opposite sides of longitudinal planes perpendicular to said sections and passing through said apexes.

* * * * *